United States Patent [19]

Dietz

[11] 4,070,143

[45] Jan. 24, 1978

[54] FUEL IGNITION SYSTEM INCLUDING AN IGNITER PROVIDING A LINGERING SPARK

[75] Inventor: Gerald Edward Dietz, Goshen, Ind.

[73] Assignee: Johnson Controls, Inc., Milwaukee, Wis.

[21] Appl. No.: 698,161

[22] Filed: June 21, 1976

[51] Int. Cl.[2] ..... F23Q 9/08

[52] U.S. Cl. ..... 431/43; 431/45; 431/25; 431/46

[58] Field of Search ..... 431/43, 26, 42, 45, 431/46, 24, 25, 50, 71, 72, 73

[56] References Cited

U.S. PATENT DOCUMENTS

| | | | |
|---|---|---|---|
| 3,273,019 | 9/1966 | Matthews | 431/45 |
| 3,423,158 | 1/1969 | Forbes | 431/46 |
| 3,501,253 | 3/1970 | Wade | 431/43 |
| 3,902,839 | 9/1975 | Matthews | 431/25 X |

*Primary Examiner*—William F. O'Dea
*Assistant Examiner*—Larry Jones
*Attorney, Agent, or Firm*—Emrich, Root, O'Keeffe & Lee

[57] ABSTRACT

A fuel ignition system including a control arrangement which provides an interlock on start-up to prevent the energization of fuel valves of the system under certain failure conditions, and an igniter which is enabled when the system is activated to provide ignition sparks for igniting fuel supplied to a fuel outlet, the igniter being disabled when a flame sensing relay operates and a timing circuit of the igniter permitting the igniter to provide ignition sparks for a predetermined time duration following the operation of the flame sensing relay.

12 Claims, 1 Drawing Figure

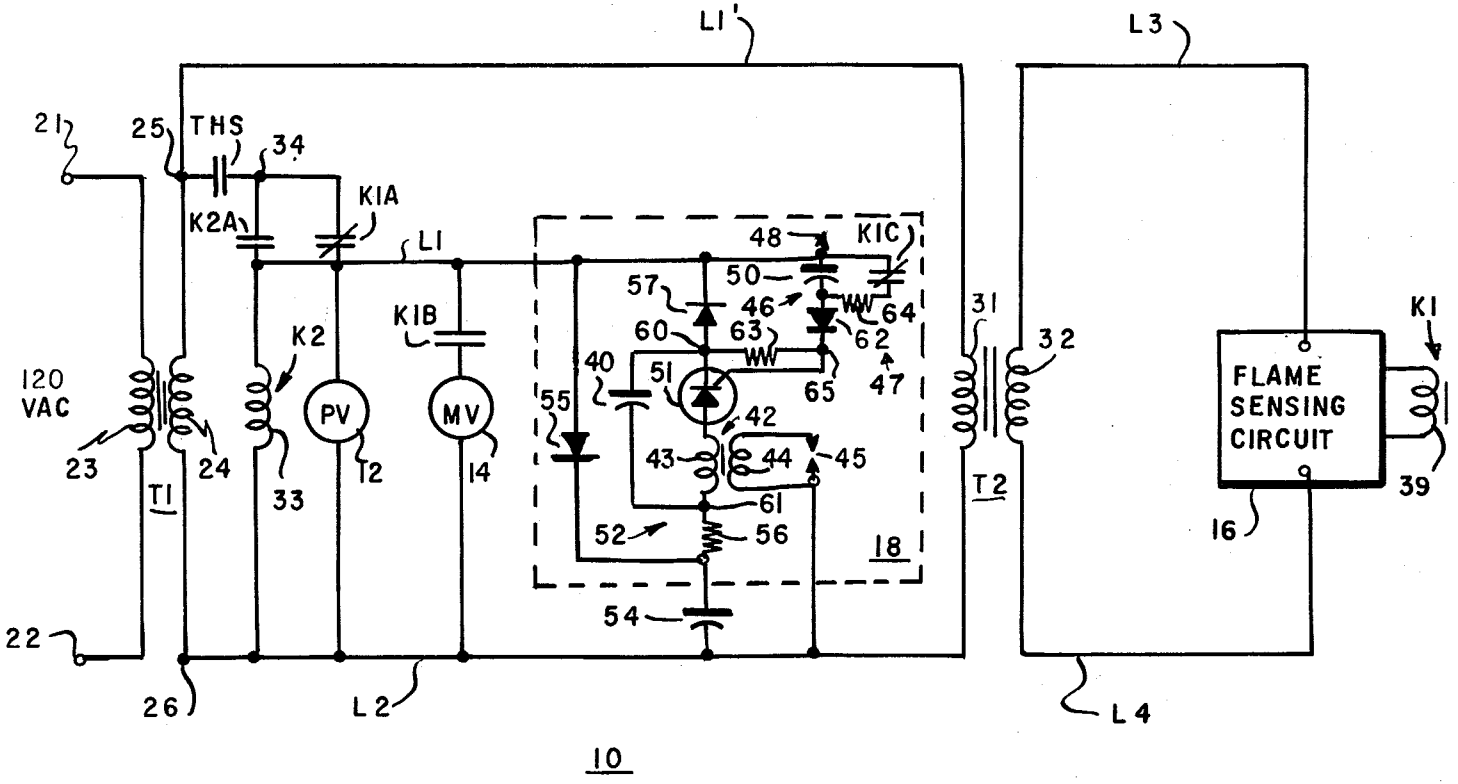
FLAME SENSING CIRCUIT
MV
PV
120 VAC
K1
K1A
K1B
K1C
K2
K2A
THS
T1
T2
L1
L1'
L2
L3
L4
10
12
14
16
18
21
22
23
24
25
26
31
32
33
34
39
40
42
43
44
45
46
47
48
50
51
52
54
55
56
57
60
61
62
63
64
65

FUEL IGNITION SYSTEM INCLUDING AN IGNITER PROVIDING A LINGERING SPARK

BACKGROUND OF THE INVENTION

1. Field of the Invention

This invention relates to fuel ignition systems of the pilot ignition type, and more particularly, to a fuel ignition system including an igniter which is disabled following operation of a flame sensing relay and which is operable to provide ignition sparks for a predetermined time after the operation of the relay.

2. Description of the Prior Art

In known fuel ignition systems of the pilot ignition type, a pilot valve is operated in response to the closure of thermostatically controlled contacts to supply fuel to a pilot outlet for ignition by a suitable igniter to establish a pilot flame. A pilot flame sensing circuit detects the pilot flame and effects the energization of a main valve which supplies fuel to a main burner apparatus for ignition by the pilot flame and the deenergization of the igniter.

Typically, the operation of the main valve and the igniter is controlled by a relay of the flame sensing circuit which has normally open contacts connected in the energizing path for the main valve and normally closed contacts connected in an energizing path for the igniter. When a pilot flame is established, the flame sensing circuit energizes the relay which operates its contacts to energize the main valve and to deenergize the igniter.

However, for a circuit failure which permits the relay of the flame sensing circuit to be energized at start up in the absence of a pilot flame, both the pilot valve and the main valve will be energized and the igniter will be deenergized and fuel will emanate from the pilot outlet and the main burner.

Various interlock arrangements have been proposed in the prior art, as exemplified by the U.S. Pat. Nos. 3,449,055 to J. C. Blackett, 3,644,074 to P. J. Cade and 3,709,783 to J. S. Warren, in which the energization of the fuel valves of the system is dependent upon the sequential operation of relays. In such systems, the energization of the pilot valve and igniter is effected in response to operation of a control relay which can be energized only if a flame sensing relay is deenergized. Once energized, the holding relay is maintained operated over a holding path provided by contacts of the relay. Thereafter, the energization of the main valve and the deenergization of the igniter is effected in response to the operation of the flame sensing relay when a pilot flame is established, but only if the control relay is energized.

However, in such systems, the operation of the flame sensing relay is effected over an electronic control circuit which is energized in response to the closing of thermostatically controlled contacts, and for failure of the control circuit which permits the flame sensing relay to be energized in the absence of a flame, the energization of the flame sensing relay may be delayed for a time following activation of the system. Accordingly, under certain conditions, the flame sensing relay may remain deenergized long enough to permit the control relay to operate, resulting in the unsafe condition referred to above with the pilot valve and main valve operated and the igniter deenergized.

SUMMARY OF THE INVENTION

The present invention has provided a fuel ignition system including pilot valve means operable when energized to supply fuel to a pilot outlet, an igniter means operable when enabled to provide sparks for igniting the fuel to establish a flame at the outlet, and a flame sensing means responsive to the flame to operate an associated switching means, to effect the energization of a main valve means to supply fuel to a main burner apparatus for ignition. The igniter means is enabled when the system is activated, and is disabled whenever the switching means is operated.

In accordance with the present invention, the igniter means includes timing means for enabling the igniter means to generate ignition sparks for a predetermined time duration following the operation of the switching means. Accordingly, in the event that the switching means is operated in the absence of a flame as the result of a failure condition in the flame sensing means, the igniter means continues to provide ignition sparks for the predetermined time duration, permitting ignition of the fuel supplied to the pilot outlet and the main burner apparatus.

The fuel ignition system may include an interlock arrangement wherein the energization of fuel valves of the system is dependent upon the sequential operation of first and second switching means. The first switching means being associated with the flame sensing means and being maintained disabled in the absence of a flame to provide an energizing path for the pilot valve means, the igniter means and the second switching means when the system is activated. The first switching means is enabled by the flame sensing means when a flame is established and operates to energize the main valve means to supply fuel to the main burner apparatus to interrupt the energizing path and to disable the igniter means, the pilot valve means and the main valve means being maintained energized over a holding path provided by the second switching means. In the event of a failure of the flame sensing circuit which permits the first switching means to be enabled in the absence of a flame and after the second switching means is enabled, the timing means of the igniter means permits ignition sparks to be provided for a known duration of time following the operation of the first switching means, permitting ignition of fuel supplied to the pilot outlet and the main burner apparatus.

In accordance with a disclosed embodiment, the ignite means is of the capacitive discharge type, and includes an ignition capacitor which is charged and then discharged over an ignition transformer during alternate half cycle of an AC signal supplied to the igniter means for activating ignition electrode means providing ignition sparks. The ignition capacitor is charged during one half cycle of the AC signal and during the next half cycle begins to discharge over one of two discharge paths. A first one of the discharge paths includes the timing means which is embodied as a capacitor, and the second discharge path includes normally closed contacts of the switching means associated with the flame sensing means, which may comprise a relay. The contacts of the relay are connected in shunt with the timing capacitor, and thus as long as the relay is deenergized, the timing capacitor is effectively short circuited and the ignition capacitor is permitted to charge and discharge during successive cycles of the AC signal to activate the ignition electrode means providing ignition sparks.

When energized, the relay operates to open the contacts, interrupting the second discharge path, permitting the ignition capacitor to discharge over the first discharge path, including the timing capacitor. For such condition, the charging and discharging of the ignition capacitor continues until the timing capacitor is charged after which time the igniter means is disabled and spark generation is terminated.

DESCRIPTION OF THE DRAWING

The single FIGURE which comprises the drawing is a schematic circuit diagram of a control circuit for a fuel ignition system which includes an igniter provided in accordance with the present invention.

DESCRIPTION OF A PREFERRED EMBODIMENT

Referring to the drawing, the igniter 18, provided by the present invention, is described with reference to an application in a fuel ignition system 10. As shown in the drawing, which is a schematic circuit diagram of a control circuit for the fuel ignition system 10, the system 10 includes a pilot valve 12, a main valve 14, a flame sensing circuit 16, and the igniter 18.

The pilot valve 12, which is connected between conductors L1 and L2, is operable when energized in response to application of power to the conductors L1 and L2 to supply fuel to a pilot outlet for ignition by ignition sparks provided by the igniter 18 to establish a pilot flame. The flame sensing circuit 16 is operable when energized to respond to the pilot flame to energize an associated relay K1 which operates to close contacts K1B connecting the main valve 14 between conductors L1 and L2 to effect energization of the main valve 14 to supply fuel to a main burner apparatus, and to open contacts K1C to disable the igniter 18.

The control circuit includes an interlock arrangement, which is disclosed in detail in the U.S. patent application Ser. No. 698,162, June 21, 1976, of Russell B. Matthews, which was filed concurrently with the present application. The interlock arrangement provides an energizing path for the pilot valve 12, the main valve 14 and the igniter 18 over normally closed contacts K1A of relay K1 permitting energization of the pilot valve 12 and the igniter 18 whenever thermostatically controlled contacts THS close in response to a request for heat. The energizing path is interrupted when relay K1 operates to open contacts K1A, and a holding path is provided by contacts K2A of an interlock relay K2. The operate winding 33 of relay K2 is connected between conductors L1 and L2 and is energized when power is applied to conductors L1 and L2. Failure of relay K2 to operate prior to the operation of relay K1 results in the shut down of the system.

Thus, the relays K1 and K2, provide a contact interlock protection which prevents start up if for any reason the normally closed contacts K1A of the relay K1 are open at start up. Such condition may occur due to a failure in the flame sensing circuit 16, which permits relay K1 to be energized when contacts THS close even though a pilot flame is not established, or in the case that contacts K1B, which control the energization of the main valve 14 become welded together.

In addition, the igniter circuit 18 is disabled by relay K1 of the flame sensing circuit 16 when relay K1 operates, is operable to provide a lingering spark following operation of the relay K1 as will be described hereinafter.

Considering the fuel ignition system 10 in more detail, power is supplied to the system 10 over a stepdown transformer T1 which has a primary winding 23 connected to input terminals 21 and 22, which are connectable to a 120 volt 60 Hz AC voltage source, and a secondary winding 24 connected to provide 25 VAC between terminals 25 and 26. Conductor L1 is connected over normally closed contacts K1A of relay K1 and normally open thermostatically controlled contacts THS to terminal 25, the conductor L2 is connected directly to terminal 26.

The flame sensing circuit 16 is energized over a transformer T2 which has a primary winding 31 connected to conductor L2 and a conductor L1', which is connected to terminal 25, and a secondary winding 32 connected between conductors L3 and L4 which are connected to input terminals of the flame sensing circuit 16. Accordingly, the flame sensing circuit 16 is energized continually.

The flame sensing circuit 16 may be the type disclosed in the U.S. Pat. No. 3,902,839 of R. B. Matthews, which issued on Sept. 2, 1975. The operation of the flame sensing circuit is described in detail in referenced patent. As shown in the referenced patent, the flame sensing circuit 16 includes a flame sensing electrode which is positioned adjacent the pilot outlet and a control circuit which responds to the presence of a flame at the sensing electrode to effect energization of the operate winding 39 of relay K1 to open contacts K1C for disabling the igniter 18, to close contacts K1B to connect the main valve 14 to conductors L1 and L2, and to open contacts K1A to interrupt the energizing path for the pilot valve 12, the main valve 14 and the igniter 18, and the flame sensing circuit 16 which are maintained energized over the holding path provided by contacts K2A of relay K2.

Relay K1 comprises a double pole double throw relay (DPDT) with contacts K1A and K1B employing a common armature of the relay K1 such that whenever contacts K1B are closed, contacts K1A are open. Also, should contacts K1B become welded, contacts K1A cannot reclose.

Referring to the igniter circuit 18, the igniter circuit is of the capacitive discharge type and includes a capacitor 40 which is charged and then discharged over the primary winding 43 of an ignition transformer 43, during alternate half cycles of the AC line signal to provide sparks over a pair of ignition electrodes 45 which are connected to the secondary winding 44 of the ignition transformer 42. The capacitor 40 is charged during one half cycle of the AC line signal and during the next half cycle begins to discharge over one of two current paths 46 or 47 one of which includes a timing network 48, including a capacitor 50 and the other of which includes normally closed contacts K1C of the relay K1, which are connected in shunt with capacitor 50. Accordingly, as long as relay K1 is deenergized, the capacitor 50 is effectively short circuited and the capacitor 40 is permitted to charge and discharge indefinitely to activate the electrodes 45, providing ignition sparks. When relay K1 is energized, contacts K3C are opened, interrupting the current path 47 and the discharge of the capacitor 40 is initiated over the other current path 46, including capacitor 50. For such condition, the charging and discharging of capacitor 40 continues until the capacitor 50 is charged after which time the igniter 18 is disabled.

In response to capacitor discharge current flow over either one of the current paths 46 or 47, a controlled switching device, embodied as a silicon controlled rectifier 51, is enabled, providing a discharge path for the capacitor 40 over the primary winding 43 of the ignition transformer 42 inducing a voltage in the secondary winding 44 which is applied to the electrodes 45, causing a spark to be generated.

More specifically, the ingiter 18 includes a voltage doubler circuit 52, including a capacitor 54 which supplies a voltage to capacitor 40, enabling capacitor 40 to be charged to approximately twice the line voltage. Capacitor 54 has a charging path which extends from conductor L1 over a diode 55 and the capacitor 54 to conductor L2. Capacitor 54 is charged when conductor L1 is positive relative to conductor L2 during positive half cycles of the AC line signal.

Capacitor 40 charges during negative half cycles of the AC line signal, that is when conductor L2 is positive relative to conductor L1, over a path which extends from line L2 to one side of capacitor 40 at point 61 over capacitor 54 and a resistor 56, and from the other side of capacitor 40 at point 60, over a diode 57 to line L1.

The SCR device 51 has its anode connected to conductor L2 over the primary winding 43 of transformer 43, resistor 56, and capacitor 54 and its cathode connected to conductor L1 over diode 57. The current paths 46 and 47, provide a gate control circuit for the SCR device 51. The current path 46 includes capacitor 50, a diode 62 and a resistor 63 which are connected in series between line L1 and poing 60. The other current path 47 includes normally closed contacts K1C of relay K1, a resistor 64, diode 62 and resistor 63 which are connected between line L1 and point 60, contacts K1A and resistor 64 being connected in shunt with capacitor 50.

The gate of the SCR device 51 is connected to the junction of the cathode of diode 62 and resistor 63 at point 65 and is rendered conductive whenever the potential at point 65 exceeds the gate threshold of the SCR device 51.

In operation, when thermostatically controlled contacts THS close in response to a request for heat, power at 25 VAC is applied to conductors L1′ and L2 over contacts THS for energizing the flame sensing circuit 16 over transformer T2, and to conductors L1 and l2 over contacts THS and normally closed contacts K1A of relay K1 to energize the pilot valve 12 and the igniter 18. When the pilot valve 12 is energized, fuel is supplied to a pilot outlet for ignition by ignition sparks provided by the igniter 18. In addition, relay K2 operates to close contacts K2A to provide a holding path for the relay K2, the pilot valve 12, and the igniter circuit 18.

With reference to the igniter circuit 18, when line L1 is positive relative to line L2, capacitor 54 is charged over diode 55 to a voltage of approximately 35 volts. When line L2 becomes positive relative to line L1 during the next negative half cycle of the AC line signal, capacitor 40 is charged over capacitor 54, resistor 56 and diode 57, with the charge on capacitor 54 being transferred to capacitor 40, such that capacitor 40 is charged to approximately 70 volts. During the next half cycle, when line L1 is again positive relative to line L2 and the AC signal begins to decrease from its maximum valve, the voltage on capacitor 40 is greater than the supply voltage, permitting current to flow from the positive side of the capacitor 40 at point 61 through resistor 56, capacitor 54, the secondary winding 24 of the input transformer T1, and over current path 47, including normally closed contacts of relay K1, resistor 64, diode 62 and resistor 63, to the negative side of the capacitor 40 at point 60, establishing a positive voltage at point 65 which is connected to the gate of SCR 51 which then conducts. When the SCR device conducts, capacitor 40 discharges over the primary winding 43 of the ignition transformer 42 and the anode to cathode circuit of the SCR device 51, inducing a voltage in the secondary winding 44 of the ignition transformer 42, activating the electrodes 45 to generate an ignition spark. The igniter circuit 18 continues to operate in the manner described above, providing ignition sparks until the fuel supplied to the pilot outlet is ignited.

The flame sensing circuit 16 responds to the pilot flame to effect the energization of the operate coil 39 of relay K1 which operates to close contacts K1B, which are connected in series with the main valve 14 between conductors L1 and L2, permitting the main valve 14 to operate to supply fuel to the main burner apparatus for ignition by the pilot flame. In addition, normally closed contacts K1C are opened to disable the igniter circuit 18, and normally closed contacts K1A are opened, interrupting the energizing path for relay K2, the pivot valve 12 and the igniter circuit 18 which are maintained energized over contacts K2A of relay K2.

Digressing, under normal conditions, relay K1 is maintained deenergized until a pilot flame is established at which time the relay K1 is energized to operate the main valve 14 and disable the igniter circuit 18 as described above. In the event of a failure condition following a successful start up, such as a change in the circuit characteristic of the flame sensing circuit 16 causing the relay K1 to energize without pilot flame following by a line voltage interruption, then when power is restored, relay K2 will energize before relay K1, as in a normal start up, and relay K1 will energize without pilot flame because of the fault. When relay K1 operates, contacts K1C open to disable the igniter 18. However, the igniter continues to provide sparks to ignite the fuel supplied to the pilot outlet and the main burner to provide heat to complete the heating cycle causing the THS contacts to open. On the next call for heat, the control circuit and fuel valves are locked out and will not start up because of the circuit fault which maintains relay K1 operated.

When contacts K1C open, current path 47 is interrupted. However, capacitor 40 continues to be charged and begins to discharge over the current path 46, including timing capacitor 50. That is, when the voltage on capacitor 40 becomes greater than the supply voltage during the positive half cycles of the AC line signal, current flows from the positive side of capacitor 40 at point 61 resistor 56, capacitor 54, the secondary winding 24 of the input transformer T1, capacitor 50, diode 62 and resistor 63 to the negative side of capacitor 40 at point 60, providing a turnon voltage at point 65 for the SCR device 51, permitting capacitor 40 to be discharged over the primary winding 43 of the ignition transformer 42, causing ignition sparks to be generated. The sparking continues until the timing capacitor 50 becomes fully charged at which time current flow ceases and the potential at point 65 drops to zero. Accordingly, the SCR device 51 is not triggered and further spark generation is inhibited. In one embodiment in which the value of the timing capacitor was 0.22 microfarads, and resistors 63 and 56 were 1K ohms and 680 ohms, respectively, the igniter circuit 18 was maintained operable to provide ignition sparks for a period of ten seconds following the operation of relay K1. It should be noted that long time delays can be achieved using low values for the timing capacitor 50 because the capacitor charging current is of a very short duration, typically on the order of 7 microseconds.

Thus, for a failure condition of the type noted above, the igniter circuit 18 remains operative to provide ignition sparks for time after operation of relay K1, for igniting fuel supplied to the pilot outlet and the main burner apparatus.

When the heating demand has been met and contacts THS open, relay K2 is deenergized, along with the pilot valve 12 and the main valve 14, extinguishing the flame at the pilot outlet and the main burner. The flame sensing circuit 16 responds to the loss of flame to deenergize relay R1 which opens contacts R1B to interrupt the energizing path for the main valve 14 and to close contacts K1A and K1C, and the system 10 is prepared for the next heating cycle.

In the event of a failure condition following a successful start up, such as the welding together of the contacts K1B which control the operation of the main valve 14, then when the heating demand has been met, and contacts THS open, the pilot valve 12 and the main valve 14 are deenergized, extinguishing the flame. The flame sensing circuit 16 responds to the loss of flame to deenergize relay K1. However, since contacts K1B are welded together, contacts K1A cannot reclose. Accordingly, when contacts THS close on the next call for heat, the energizing path for the pilot valve 12 is interrupted causing the pilot valve 12 and the main valve 14 to be maintained in a lock out condition.

In the event of a failure in the flame sensing circuit 16 which permits relay K1 to remain operated in the absence of a flame, contacts K1A are maintained open such that upon the closure of contacts THS, the energizing path for the relay K2 and the pilot valve 12 is interrupted, preventing operation of the pilot valve 12 and the system 10 is maintained in a lock out condition.

I claim:

1. In a fuel ignition system including a pilot valve means operable when energized to supply fuel to a fuel outlet for ignition to establish a pilot flame, main valve means operable when energized to supply fuel to a main burner apparatus for ignition by the pilot flame, and flame sensing means responsive to the pilot flame to effect energization of said main valve means, a control arrangement comprising activate means responsive to a request signal to complete an energizing path for said pilot valve means, igniter means connected to said energizing path and operable when enabled to provide sparks in the proximity of said outlet for igniting fuel supplied to said outlet to establish a flame, and switching means controlled by said flame sensing means to be normally disabled in the absence of a pilot flame for enabling said igniter means to provide sparks, and to be enabled when a pilot flame is established to cause the igniter means to be disabled, said igniter means including timing means effective when said switching means is enabled to maintain said igniter means enabled for a predetermined time interval after said switching means is enabled, permitting said igniter means to continue to provide sparks during said time interval.

2. A system as set forth in claim 1 wherein said igniter means includes ignition electrode means, capacitor means and circuit means for permitting said capacitor means to charge toward a predetermined potential, said switching means permitting said capacitor means to discharge over a first path whenever said switching means is deenergized and to discharge over a second path, including said timing means, whenever said switching means is enabled, and means responsive to said capacitor means to supply capacitor discharge current to said ignition electrode means to effect the generation of sparks.

3. A system as set forth in claim 2 wherein said switching means comprises a relay having normally closed contacts connected in said first path to provide a shunt path around said timing means whenever said switching means is disabled.

4. In a fuel ignition system including a pilot valve means operable when energized to supply fuel to a fuel outlet for ignition to establish a pilot flame, main valve means operable when energized to supply fuel to a main burner apparatus for ignition by the pilot flame, and flame sensing means responsive to the pilot flame to effect energization of said main valve means, a control arrangement comprising activate means responsive to a request signal to complete an energizing path for said pilot valve means, interlock means connected to said energizing path and operable in response to said activate means to provide a holding path for said pilot valve means, igniter means connected to said energizing path and operable when enabled to provide sparks in the proximity of said outlet for igniting fuel supplied to said outlet to establish a flame, and switching means controlled by said flame sensing means to be normally deenergized in the absence of a pilot flame for enabling said igniter means, said switching means being operable when energized to interrupt said energizing path and to connect said main valve means to said holding path for energization and to disable said igniter means, said igniter means being maintained energized over said holding path following operation of said switching means, said igniter means including timing means for permitting said igniter means to be operable to generate sparks for a predetermined time whenever said switching means is operated in the absence of a pilot flame after said holding path is provided.

5. In a fuel ignition system including pilot valve means operable when energized to supply fuel to a fuel outlet for ignition to establish a pilot flame, main valve means operable when energized to supply fuel to a main burner apparatus for ignition by the pilot flame, and flame sensing means responsive to the pilot flame to effect energization of said main valve means, a control arrangement comprising activate means operable in response to a request signal to complete an energizing path for said pilot valve means to effect energization of said pilot valve means, igniter means connected to said energizing path to be responsive to said activate means to generate ignition sparks for igniting fuel supplied to said outlet, first switching means energized in response to said activate means to provide a holding path for said pilot valve means and said igniter means, second switching means controlled by said flame sensing means to be normally deenergized in the absence of a pilot flame for enabling said igniter means to provide sparks, and said second switching means being operable when a pilot flame is established to cause said igniter means to be disabled and to interrupt said energizing path and connect said main valve means to said holding path for energization, said igniter means including timing means controlled by said second switching means to be effective, upon operation of said second switching means, to maintain said igniter means enabled for a predetermined time following the operation of said second switching means, permitting said igniter means to continue to provide sparks during said predetermined time.

6. In a fuel ignition system including pilot valve means operable when energized to supply fuel to a fuel outlet for ignition to establish a pilot flame, activate means responsive to a request signal for energizing said pilot valve means, main valve means operable when energized to supply fuel to a main burner apparatus for ignition by the pilot flame, and flame sensing means responsive to the pilot flame to effect energization of an associated switching means for energizing said main valve means, an igniter means for providing sparks in the proximity of said outlet for igniting fuel supplied to said outlet to establish a flame, said igniter means comprising ignition electrode means and control means operable when enabled to periodically activate said ignition electrode means, said switching means being controlled by said flame sensing means to be normally deenergized in the absence of pilot flame for enabling said control means, and said switching means being energized when a pilot flame is established to cause said igniter means to be disabled, said igniter means further including timing means effective upon operation of said switching means to permit said control means to continue to periodically activate said ignition electrode means to provide sparks for a predetermined time interval after said switching means is energized.

7. A system as set forth in claim 6 wherein said control means includes capacitor means and circuit means for permitting said capacitor means to charge toward a predetermined potential, said switching means permitting said capacitor means to discharge over a first path whenever said switching means is deenergized and to discharge over a second path, including said timing means, whenever said switching means is energized, and means responsive to said capacitor means to supply capacitor discharge current to said ignition electrode means.

8. In a fuel ignition system including pilot valve means operable when energized to supply fuel to a fuel outlet for ignition to establish a pilot flame, activate means responsive to a request signal for energizing said pilot valve means, main valve means operable when energized to supply fuel to a main burner apparatus for ignition by the pilot flame, and flame sensing means responsive to the pilot flame to effect energization of an associated switching means for energizing said main valve means, an igniter means for providing sparks in the proximity of said outlet for igniting fuel supplied to said outlet to establish a flame, said igniter means comprising electrode means, timing means, and control means operable when enabled to periodically activate said ignition electrode means, said control means including capacitor means and circuit means for permitting said capacitor means to charge toward a predetermined potential, said switching means being controlled by said flame sensing means to be normally deenergized in the absence of a pilot flame, permitting said capacitor means to discharge over a first path, and said switching means being energized when a pilot flame is established, permitting said capacitor means to discharge over a second path including said timing means, said control means including means responsive to said capacitor means to supply capacitor discharge current to said ignition electrode means, said timing means permitting said control means to continue to periodically activate said ignition electrode means to permit said igniter means to provide sparks for a predetermined time interval after said switching means is energized, and said timing means including means for determining the time duration for which said igniter means continues to provide sparks after said switching means is energized.

9. A system as set forth in claim 8 wherein said means for determining includes further capacitor means connected in said second path, said switching means having normally closed contacts connected in said first path and providing a path around said further capacitor means whenever said switching means is deenergized.

10. In a fuel ignition system including a pilot valve means operable when energized to supply fuel to a fuel outlet for ignition to establish a pilot flame, main valve means operable when energized to supply fuel to a main burner apparatus for ignition by the pilot flame, and flame sensing means responsive to the pilot flame to enable an associated first switching means for effecting energization of said main valve means, an igniter means comprising control means including capacitor means, first circuit means connected to a source of cyclical AC signals for permitting said capacitor means to charge toward a predetermined potential during a first half cycle of said AC signal, second circuit means for permitting said capacitor means to discharge over a first discharge path during a second half cycle of the AC signal, second switching means enabled in response to the discharge of said capacitor means to activate ignition electrode means to generate an ignition spark, said first switching means being operable when enabled to interrupt said first discharge path, and timing means providing a second discharge path for permitting said capacitor means to continue to be charged and discharged during respective first and second half cycles of said AC signal for effecting the generation of sparks for a predetermined time after said first discharge path is interrupted.

11. A system as set forth in claim 10 wherein said timing means includes further capacitor means.

12. In a fuel ignition system including a pilot valve means operable when energized to supply fuel to a fuel outlet for ignition to establish a pilot flame, main valve means operable when energized to supply fuel to a main burner apparatus for ignition by the pilot flame, and flame sensing means responsive to the pilot flame to enable an associated first switching means for effecting energization of said main valve means, an igniter means comprising control means including capacitor means, first circuit means connected to a source of cyclical AC signals for permitting said capacitor means to charge toward a predetermined potential during a first half cycle of said AC signal, second circuit means for permitting said capacitor means to discharge over a first path during a second half cycle of the AC signal, second switching means enabled in response to the discharge of said capacitor means to activate ignition electrode means to generate an ignition spark, said capacitor means being permitted to discharge over a second path whenever said first path is interrupted, and timing means including further capacitor means connected in said second path for permitting said first-mentioned capacitor means to be charged and discharged during respective first and second half cycles of said AC signal for effecting the generation of sparks for a predetermined time after said first path is interrupted, said first switching means comprising a relay having normally closed contacts connected in said first path and providing a shunt path around said further capacitor means whenever said relay is deenergized, said relay being operable when energized to open said contacts to interrupt said first path and to permit discharge current to flow over said second path, including said further capacitor means, until said further capacitor means is fully charged.

* * * * *

UNITED STATES PATENT OFFICE

CERTIFICATE OF CORRECTION

Patent No. 4,070,143 Dated January 24, 1978

Inventor(s) Gerald Edward Dietz

It is certified that error appears in the above-identified patent and that said Letters Patent are hereby corrected as shown below:

Column 4, line 36, "and the flame sensing circuit 16" should be deleted;

Column 5, line 44, "is" should be deleted;

line 45, "over contacts THS" should be deleted;

line 46, "and" should be deleted and --is extended-- should be inserted before "to".

Column 5, line 47, "12" should be --L2--.

Signed and Sealed this

Fourth Day of July 1978

[SEAL]

Attest:

RUTH C. MASON
Attesting Officer

DONALD W. BANNER
Commissioner of Patents and Trademarks